United States Patent [19]

Braverman

[11] Patent Number: 4,725,240

[45] Date of Patent: Feb. 16, 1988

[54] ELECTRICAL SOCKET

[76] Inventor: Jeffrey I. Braverman, 9 Horseshoe La., Lake Success, N.Y. 11020

[21] Appl. No.: 54,711

[22] Filed: May 27, 1987

[51] Int. Cl.[4] ..... H01R 4/66; H01R 13/652

[52] U.S. Cl. ..... 439/105; 439/223; 439/682

[58] Field of Search ..... 439/101, 105, 106, 217, 439/221, 222, 223, 682

[56] References Cited

FOREIGN PATENT DOCUMENTS 2097202 10/1982 United Kingdom ..... 439/105

*Primary Examiner*—Eugene F. Desmond

*Attorney, Agent, or Firm*—Wolder, Gross & Yavner

[57] ABSTRACT

An electrical socket compatible with NEMA 5-15 and IEC 320 male connectors having conductor prong-accepting recesses, an IEC 320 shield-accepting peripheral recess and a pair of ground prong-accepting recesses, located to accept the ground prongs of both NEMA 5-15 and IEC 320 configurations. The ground prong-accepting recesses are provided with conductive inserts which are joined together to allow electrical continuity to be established with the ground prongs of either configuration.

3 Claims, 6 Drawing Figures

FIG. 3
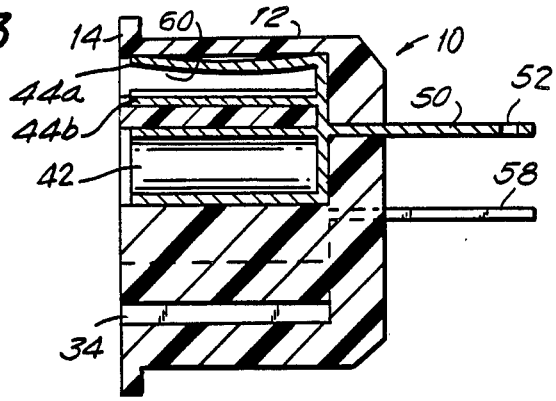
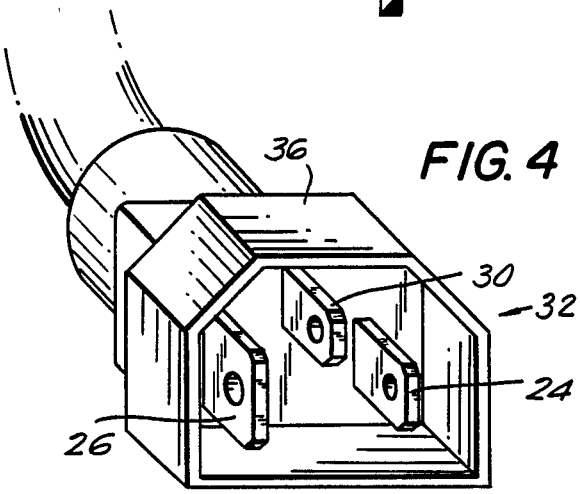
FIG. 4
FIG. 5
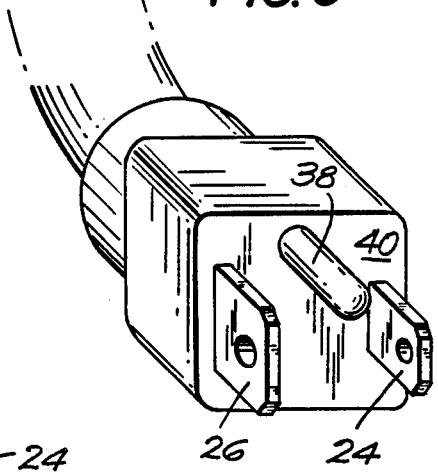
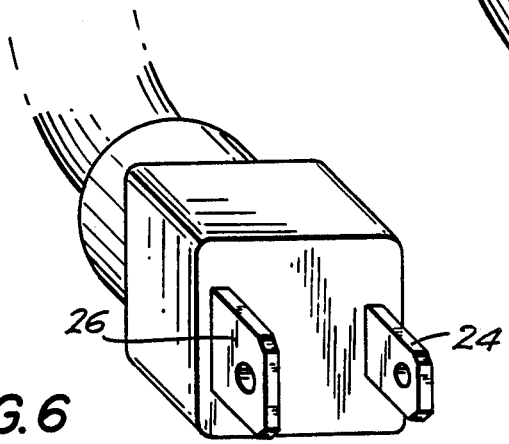
FIG. 6

ELECTRICAL SOCKET

BACKGROUND OF THE INVENTION

The present invention relates to the electrical-mechanical arts and in particular to an improved socket for use in connection with computers and other devices.

Typical connector devices utilized in conjunction with electrical apparatus powered by standard 120 volt alternating current are provided, in the case of male plugs, with a pair of parallel plug members between which the voltage is established, as well as an offset, generally cylindrical or U-shaped ground plug element. In the case of sockets, mating apertures containing appropriate contact elements are provided. Such a socket is identified by the industry designation NEMA 5-15S, the matching plug being designated NEMA 5-15P.

Such plug and socket configurations are utilized in a wide variety of electrical equipment, including, for example, micro or "personal" computers. In such an environment a socket is often provided on the rear apron of the microprocessor cabinet to allow a peripheral, such as a cathode ray tube (CRT) to be attached to the microprocessor and receive its power therefrom. As the NEMA standard is recognized throughout the industry, the use of such a standard plug and socket arrangement allows for interchangeability and compatability between manufacturers and devices.

More recently, however, various electrical apparatus have been provided with an alternative form of plug and socket arrangement. Such an arrangement utilizes three parallel elements for voltage provision and ground, and surrounds such connectors with a hexagonal shield. Such connectors, both male and female, have been given the industry designation IEC 320. Equipment provided with an IEC 320 connector is incompatible with equipment having a NEMA 5-15 connector and accordingly a variety of adaptor units, having a NEMA 5-15 plug or socket at one end and an IEC 320 plug or socket at the other, have been provided to allow interconnection of otherwise incompatible units. Heretofore, however, there has been no provision made for a socket which may be incorporated into electrical equipment that would allow connection with both the NEMA 5-15 plug and the IEC 320 plug.

SUMMARY OF THE INVENTION

In light of the foregoing, the purpose of the present invention is to provide an electrical socket compatible with both NEMA 5-15 and IEC 320 plugs. The socket of the present invention includes a socket body formed for an appropriate insulating material. Formed in the front face of the body is a pair of generally rectangular plug prong-accepting apertures having contact means therein mateable with the inserted plug elements. A ground prong-accepting aperture is located between and displaced upwardly from the primary apertures in position to mate with the ground prong of an IEC 320 plug. A hexagonal recess surrounding the socket apertures is provided to mate with the shield of the IEC 320 plug. The opposed inner walls of the shield recess are provided with electrical contact means at a point equidistant between the primary plug apertures, so as to be contactable with the ground prong of a NEMA 5-15 plug. The contact means for the respective ground prongs are electrically connected and are provided with an external connection means to allow electrical contact to be made to the equipment ground. Accordingly, the socket provides a means of electrical connection between the equipment with which it is utilized and either NEMA 5-15 or IEC 320 connectors.

DESCRIPTION OF A PREFERRED EMBODIMENT

A fuller understanding of the present invention will be acquired upon consideration of the following detailed description of a preferred, but none the less illustrative embodiment of the present invention when taken in conjunction with the annexed drawings, wherein:

FIG. 3 is a side elevation view taken along line 3—3 of FIG. 1;

FIG. 4 is a front perspective view of an IEC 320 plug mateable with the socket of the present invention;

FIG. 5 is a front perspective view of a NEMA 5-15 plug mateable with the socket of the present invention; and FIG. 6 is a front perspective view of a plug having primary conductor contacts without a ground prong also mateable with the socket of the present invention.

Figure 1:
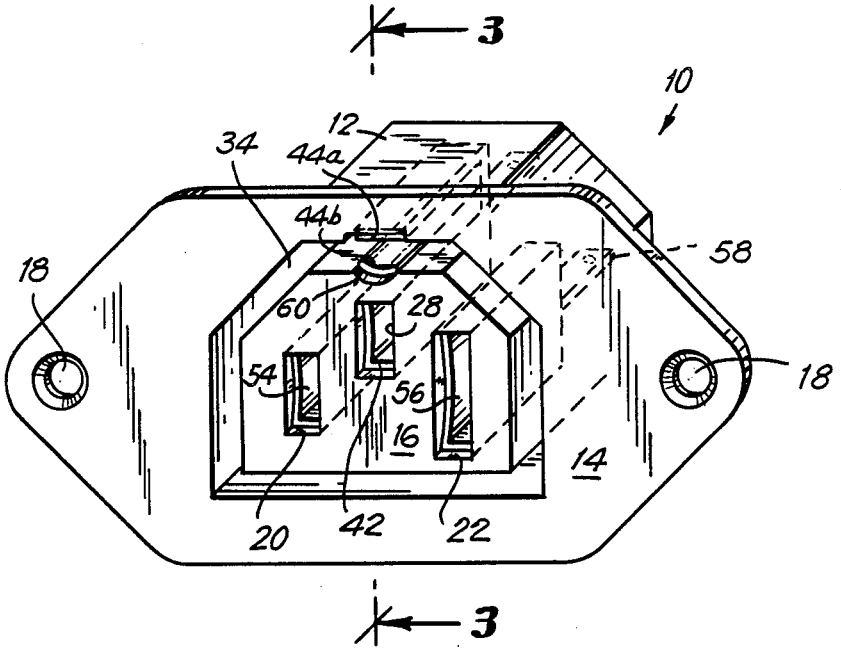
FIG. 1 is a front perspective view of the socket of the present invention.

Referring initially to FIGS. 1 and 3, socket 10 of the present invention includes socket body 12 formed of an appropriate insulating material, typically plastic, and integral mounting flange 14 which surrounds the socket body 12 proximate its front face 16, and which is provided with bores 18 to permit the socket to be mounted as required. Extending rearwardly through socket body 12 from front face 16 are two parallel prong-accepting socket means 20,22. Socket means 20,22 are rectangular in cross-section, and are sized to accommodate standard male plug elements 24,26 respectively, as illustrated in FIGS. 4–6. The use of different size prongs on the male portion of plug members intended to be utilized in connection with standard 120 volt power is an industry standard which ensures that the "hot" side of the power mains is always identified for wiring and connection purposes.

Located equidistantly between socket means 20 and 22 and similarly projecting rearwardly from socket body front face 16 is ground prong-receiving socket means 28. Socket means 28 is offset vertically from socket means 20,22 and is so located to be compatible with the ground prong 30 of plug 32 of the IEC 320 format, as shown in FIG. 4.

Surrounding socket means 20,22 and 28 are projecting rearwardly within socket body 12 from body front face 16 is hexagonal shield-accepting recess 34. This recess is sized to be compatible with the hexagonal shield 36 which surrounds the male prongs of IEC 320 plug 32.

Figure 2:
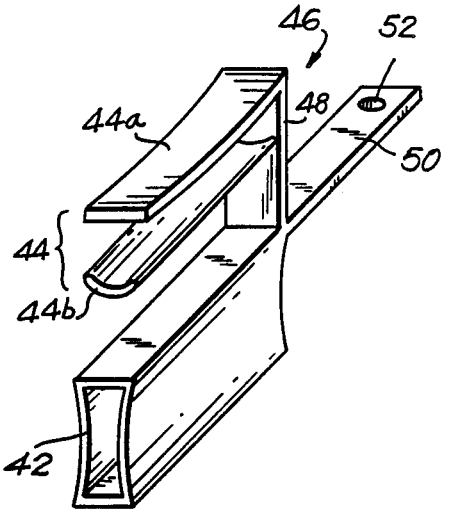
FIG. 2 is a front perspective view of the contact and connection means between the ground prong receiving portions of the socket.

As shown in FIG. 5, a male plug conforming to NEMA 5-15P standards includes, in addition to rectangular prongs 24 and 26, generally cylindrical ground prong 38 projecting from front plug face 40. To accommodate this ground pin, socket body 12 is provided with ground pin-accepting recess 60 which overlies and modifies the shape of shield-accepting recess 34. As detailed in FIG. 2, rectangular ground socket means 28 and ground pin-accepting recess 60 are each provided with conductive ground prong contacting insert portions 42,44, respectively, formed as part of ground connector element 46. Portion 44 includes top and bottom elements 44*a* and 44*b* joined at their rearmost portion by vertical stub portion 48. Portion 44*b* is curved in cross-section to conform with the curved lower inner surface portion of pin-accepting recess 60 while portion 44*a* may include a downward flex or bias to improve contact with the inserted ground plug. Portion 42 of connector element 46 may be in the general form of a hollow rectangular parallelepiped, whose inner dimensions are sized to accept male ground prong 30 as shown in FIG. 4, and may be formed with the flex as above. Connector element 46 is further provided with rearwardly extending tab 50, which extends beyond the rear face of socket body 12 and which may be provided with bore 52 to allow electrical connection to the ground-plug receiving elements.

In a similar manner, socket means 20 and 22 are provided with conductive inserts 54,56, respectively, having flexed or biased sides to allow electrical contact to be made with the inserted male prongs. Similarly, each insert 54,56 is provided with a connection tab 58 to facilitate electrical connection to the socket insert.

As an alternative to the biased or flexed design shown, inserts 46,54 and 56 may be fabricated with interior ridges or dilations as known in the art to improve mechanical and internal contact with the inserted plug members.

As presented herein, socket 10 can accordingly be utilized with plugs having either the NEMA 5-15 or the IEC 320 format, as well as plugs without a ground prong, as shown in FIG. 6. Modifications and variations to the embodiment described herein within the scope of the invention disclosed are intended to be embraced thereby, such scope to be defined as allowed by the claims set forth as follows.

What is claimed is:

1. An electrical socket, comprising a socket body having front and rear faces, said socket body being formed of an insulating material; first and second parallel male prong-accepting means located on said front face and extending rearwardly into said socket body for establishing mechanical and electrical contact with male prongs mounted therein; a first ground prong-accepting means located between said first and second male prong-accepting means and offset vertically therefrom extending rearwardly into said socket body to accept the ground prong of an IEC 320 male plug and establish electrical contact threwith; a second ground prong-accepting means located between said first and second male prong-accepting means and above said first ground plug accepting means on said front face and extending rearwardly into said socket body to accept the ground prong of a NEMA 5-15 male plug and establish electrical contact therewith; a hexagonal IEC 320 shield-accepting recess located on said front face surrounding said first and second male prong-accepting means and first ground prong-accepting means extending rearwardly into said socket body; and means electrically joining said first and second ground prong-accepting and contacting means and extending rearwardly through said rear face to permit electrical continuity to be achieved with an inserted male plug having either an IEC 320 or NEMA 5-15 ground prong.

2. The socket of claim 1, wherein said first and second ground prong-accepting means comprise recesses extending rearwardly from said front face and electrical conductor means located along at least a portion of said recesses.

3. The socket of claim 1, wherein said second ground prong-accepting means comprises a portion of said hexagonal shield-accepting recess.

* * * * *